US005504306A

United States Patent [19]

Russell et al.

[11] Patent Number: 5,504,306

[45] Date of Patent: Apr. 2, 1996

[54] MICROPROCESSOR CONTROLLED TANKLESS WATER HEATER SYSTEM

[75] Inventors: Robert G. Russell, Carson; David Kramer, Rancho Palos Verdes; Bill Graves, Manhattan Beach, all of Calif.

[73] Assignee: Chronomite Laboratories, Inc., Carson, Calif.

[21] Appl. No.: 279,956

[22] Filed: Jul. 25, 1994

[51] Int. Cl.[6] ..... H05B 1/02

[52] U.S. Cl. ..... 219/497; 219/481; 219/506; 219/502; 323/236; 323/908; 392/465; 373/102

[58] Field of Search ..... 219/497, 499, 219/501, 502, 505, 506, 508, 481, 491; 323/235, 236, 908; 392/465, 479, 485; 373/102–107

[56] References Cited

U.S. PATENT DOCUMENTS

| | | | |
|---|---|---|---|
| 4,334,147 | 6/1982 | Payne | 219/497 |
| 4,337,388 | 6/1982 | July | 219/309 |
| 4,595,825 | 6/1986 | Gordbegli | 219/306 |
| 4,638,147 | 1/1987 | Dytch et al. | 219/308 |
| 4,713,525 | 12/1987 | Eastep | 219/308 |
| 4,730,101 | 3/1988 | Mahon et al. | 219/508 |
| 4,970,373 | 11/1990 | Lutz et al. | 219/497 |
| 5,058,804 | 10/1991 | Yonekubo et al. | 236/12.12 |
| 5,079,784 | 1/1992 | Rist et al. | 4/542 |
| 5,105,067 | 4/1992 | Brekkestran et al. | 219/483 |
| 5,260,548 | 11/1993 | Todd et al. | 219/492 |
| 5,391,860 | 2/1995 | Massano et al. | 219/497 |

*Primary Examiner*—Mark H. Paschall
*Attorney, Agent, or Firm*—John F. Sicotte

[57] ABSTRACT

The present invention is an apparatus for controlling a water delivery system utilizing an instant flow tankless water heater. It includes a programmable microprocessor with support circuitry to achieve control of the outlet temperature of a varying flow rate and varying inlet temperature stream. The system senses a water outlet temperature and controls AC power through an on/off mechanism to regulate power to heating elements embedded in the water stream. The capabilities of the heating elements are improved through the application of using a microprocessor to perform a proportional (P), integrating (I) and derivative (D) calculation. The calculations are used to determine the operating characteristics of the heating system and to control the heating system.

34 Claims, 7 Drawing Sheets

MICROPROCESSOR CONTROLLED TANKLESS WATER HEATER SYSTEM

BACKGROUND OF THE INVENTION

1. Field of the Invention

The present invention relates to the field of electrical water heater systems. More particularly, the present invention relates to the field of electronically controlled tankless water heater systems.

2. Description of the Prior Art

Generally, water heaters are well known in the art. These water heaters are utilized for a variety of residential and industrial purposes. The most common water heater system presently used is the conventional hot water heater tank system. The system pumps the water into a hot water holding tank and is heated to a relatively high temperature, for example, 140° F. to 160° F. One of the disadvantages with this application is that the temperature of the water being used would be less than the temperature at which the hot water tank is maintaining the water, then the water from a cold water supply line must be added to the hot water discharged from the hot water tank to reduce the temperature of the heated water to the desired temperature so the water can be useable. This results in a significant loss of energy in the form of heat dissipation from the hot water tank and additional heat dissipation to the environment through supply conduits between the hot water tank and the water outlet.

Another disadvantage is that the hot water heater tank system in most applications is located remote from the outlets. The hot water can take a long time to get to the outlet, plus the water temperature will vary until the hot water heats the pipe and arrives at the faucet.

In another prior art application, a tankless water heater provides significant improvements over conventional hot water holding tank systems. One improvement is the efficiency which the tankless water heater provides. Since energy in the form of heat is applied only when hot water is desired, the energy loss which would occur in a conventional hot water tank system is prevented.

The disadvantage with the presently used tankless water heaters is the stress produced on heating elements within the heat exchanger when full power is immediately applied to the heating elements as the heater is initially powered up. Full power is maintained during the total time the heater is used. This instantaneous application of full power can produce significant stress on the heating elements, and thereby shortening their life span.

Another disadvantage is that it is difficult to maintain a constant water temperature. If the flow rate varies the output water temperature will also vary. The output temperature of the tankless water heater depends upon the electrical capacity and the flow rate of the faucet or showerhead. At a given flow rate and electrical capacity, the temperature rise will be constant. Another problem occurs in the winter season, the output water temperature is too cold and in the summer season, the output water temperature is too hot. To compensate for these various factors, many manufacturers construct their tankless water heaters with a switch that changes the electrical capacity for summer and winter seasons or mix hot and cold water during the summer season, wasting water and energy.

Many times tankless water heaters also have to be installed with expensive anti-scald and pressure compensating valves which are not cost effective to the system.

Another disadvantage with prior art systems is that they utilize discrete and analog components to obtain the precise set-point temperature which can lead to inaccuracy of the desired temperature and cause overshooting or undershooting of the temperature. This method is slow to respond to varying inlet water temperature variations.

The following ten (10) prior art patents were uncovered in the pertinent field of the present invention.

1. U.S. Pat. No. 4,288,685 issued to Tommaso on Sep. 8, 1981 for "Flow-Activated Resistance Heater For Water" (hereafter "the Tommaso Patent").

2. U.S. Pat. No. 4,334,147 issued to Payne on Jun. 8, 1982 for "Power Control For Appliance Using High Inrush Current Element" (hereafter "the Payne Patent").

3. U.S. Pat. No. 4,337,388 issued to July on Jun. 29, 1982 for "Rapid-Response Water Heating And Delivery System" (hereafter "the July Patent").

4. U.S. Pat. No. 4,338,511 issued to Six on Jul. 6, 1982 for "Electronic Thermostat Equipped With An Energy-Saving Device" (hereafter "the Six Patent").

5. U.S. Pat. No. 4,595,825 issued to Gordbegli on Jun. 17, 1986 for "Thermostatically Controlled Electric Water Heater" (hereafter "the Gordbegli Patent").

6. U.S. Pat. No. 4,638,147 issued to Dytch et al. on Jan. 20, 1987 for "Microprocessor Controlled Through-Flow Electric Water Heater" (hereafter "the Dytch Patent").

7. U.S. Pat. No. 4,713,525 issued to Eastep on Dec. 15, 1987 for "Microcomputer Controlled Instant Electric Water Heating And Delivery System" (hereafter "the Eastep Patent").

8. U.S. Pat. No. 4,970,373 issued to Lutz eta. on Nov. 13, 1990 for "Electronic Temperature Control System For A Tankless Water" (hereafter "the Lutz Patent").

9. U.S. Pat. No. 5,058,804 issued to Yonekubo eta. on Oct. 22, 1991 for "Automatic Hot Water Supply Apparatus" (hereafter "the Yonekubo Patent").

10. U.S. Pat. No. 5,079,784 issued to Rist eta. on Jan. 14, 1992 for "Hydro-Massage Tub Control System" (hereafter "the Rist Patent").

The Tommaso Patent discloses a flow activated resistance heater for water. It includes a movable piston supported by a flexible membrane and provided with a small flow restricting opening separates an inlet chamber.

The Payne Patent discloses a power control system for an appliance using high inrush current element. It includes a microprocessor which has been designed by permanently configuring the read only memory (ROM) to implement the control scheme of the power control system.

The July Patent discloses a rapid response water heating and delivery system for quickly and accurately heating water to a selected set point temperature of the water. It includes a water vessel which houses electrical heating elements for heating the water as it flows through the vessel. A control system employs a derivative action which takes into account the speed at which the actual temperature of the water being discharged from the vessel changes with respect to the set point temperature and modifies the average power supplied to the heating elements to minimize the actual temperature will overshoot or undershoot the set point temperature. The derivative action functions by expanding and retracting the proportional band in a specific direction to control the amount of electrical power supplied to the heating elements. A three-term amplifier provides proportional, derivative and integral control to the thyritors. The derivative and integral functions are established by R-C circuit networks to change quickly to provide power to the heating element to change the temperature of the water in direction to expeditiously attain the set point value.

The Six Patent discloses an electronic thermostat equipped with an energy saving device.

The Gordbegli Patent discloses a thermostatically controlled electric water heater for heating a flow of pool or spa water.

The Dytch Patent discloses a microprocessor which controls a flow through electric water heater. It includes a plurality of heating elements each adapted to be switched on and off in response to the microprocessor whereby the heat dissipated to the flowing water from the electric heating elements can be varied by arranging for the elements to be switched on and off in different combinations.

The Eastep Patent discloses a microcomputer which controls an instant electric water heating and delivery system. The microcomputer operates in response to a user selected flow rate and water temperature inputs to calculate the temperature difference between the cold water input and the hot water delivery output from a multisection continuous flow electric water heater.

The Lutz Patent discloses a closed loop electronic temperature control system for a tankless water heater. It teaches a differentiator/integrator. The Lutz Patent teaches dual gain selection capability in providing closer and more precise regulation of the temperature of water output by the heat exchanger. By selecting a low gain when the error signal indicates a relatively large variance between the sensed and selected water temperatures, i.e., greater than ±3° F., the overshoot by the system, which would likely result if only a high gain was used for the system, is substantially reduced. Switching to a high gain once the water temperature is within ±3° F. of the selected temperature allows the system to react more quickly to changes in the sensed water temperature, thereby providing more precise regulation of the water temperature.

The Yonekubo Patent discloses an automatic hot water supply apparatus. It includes a gas-burned instantaneous water heater unit which is supplied with cold water from a cold water supply pipe, and discharges heated hot water through a hot water supply pipe. The water heater unit has a heat exchanger in which water from a water controller is heated by a burner. The temperature of the heated water is detected by a thermistor. The detected temperature is compared with a preset temperature by a controller which actuates a proportional gas control valve to control the burner so that water will be heated to a desired temperature.

The Rist Patent discloses a control system for a hydromassage tub system. It includes a proportional control system for reducing power levels to a heater to maintain the temperature within ±2° F. As the temperature falls below the set point temperature proportional power is applied to the heater to reheat water until it approaches the set point. The power is proportionally reduced as the temperature approaches the set point temperature so that overshoot or temperature, is eliminated preventing any overheating of the tub water. Any rise and fall of the temperature is applied to integrate circuit to control the power applied to the heater through the triac.

It is desirable to design a new tankless water heater system which improves the presently used tankless water heater through the application of a proportional, integrating and derivative calculation performed by a microprocessor. These calculation are used to determine the operating characteristics of the heating system and to control the heating system with minimum components.

SUMMARY OF THE INVENTION

The present invention is an apparatus for controlling a water delivery system utilizing an instant flow tankless water heater. It includes a programmable microprocessor with support circuitry to achieve control of the outlet temperature of a varying flow rate and varying inlet temperature stream. The system senses a water outlet temperature and controls the power through an on/off mechanism to regulate power to heating elements embedded in the water stream. The capabilities of the heating elements are improved through the application of using a microprocessor to perform a proportional (P), integrating (I) and derivative (D) calculation. The calculations are used to determine the operating characteristics of the heating system and to control the heating system.

In addition, the present invention contains the capability to insure that noise and variations in line frequency cannot affect the accuracy and resolution of the PID operation.

The PID operation of the system is performed by software permanently coded into the microprocessor's control store. The equation for PID control consists of the proportional term, the integral term and the derivative term.

The proportional term is a gain constant $K_p$ times an error signal. The error signal is proportional to the difference between the desired temperature and the actual temperature. The proportional term is a constant gain for the system. This gain is a compensation for the losses, including heat loss to the device itself as well as to the surrounding air and the flowing water.

The integral term consists of an integral constant $K_i$ times the integral of the error signal over the time period since starting to the current time. The integral term adds up cumulative errors until these errors get large enough to require a reversal in direction (for example add more power or reduce the power). This is a term which causes ringing or oscillation of a system.

The derivative term consists of a derivative constant $K_d$ times the current rate of change of the error signal. The derivative term introduces a dampening effect. This term will anticipate the ringing of the system and will attempt to cancel the effect of the ringing.

The loop equation for the PID loop is then: output=$K_p$* (error)+$K_i$* sum (error)+$K_d$(error)/dt
where:

$K_P$ is the proportional constant;

$K_i$ is the integral constant; and $K_d$ is the derivative constant.

In a prior art system with only proportional control, when it is off the specified set point, the system will increase the control voltage until the error signal is zero. The system thus returns to the set point with more applied voltage than is required for maintaining equilibrium. This causes overshoot and under-damped ringing. In the present invention system, the derivative term contributes proportional to the error rate of change, but with the opposite sign of the proportional term. The role of the integral term is to eliminate steady state error.

The software design uniquely integrates the elements of the electronic circuitry with the PID algorithm. Since the P, I and D values can be calculated, the algorithm can achieve a uniquely responsive and accurate temperature not generally achievable with prior art discrete and analog components.

It is therefore an object of the present invention to provide an apparatus for controlling a water delivery system to obtain precise set point temperature.

It is also an object of the present invention to provide an apparatus which includes a tankless water heater controlled by a microprocessor capable of more close and accurate regulation of the temperature of the water being discharged.

It is an additional object of the present invention to provide an apparatus with a microprocessor which is capable of performing the proportional (P), integrating (I) and derivative (D) calculations for determining the operating characteristics of the apparatus and controlling the apparatus with minimum components.

It is a further object of the present invention to provide a software design which uniquely integrates the elements of the electronics with a PID algorithm so that the P, I and D can be calculated, and the algorithm can achieve a uniquely responsive and accurate temperature not generally achievable with prior art discrete and analog components.

It is an additional object of the present invention to provide an apparatus which includes a digital remote interface temperature selection device to accurately set the desired temperature and sending a pulse width modulated square wave to the electronic circuitry of the tankless water heater.

In the preferred embodiment of the present invention, the apparatus includes a digital remote interface temperature selection device and a tankless water heater. The desired temperature set point can be adjusted by the digital remote interface temperature selection device. A pulse width modulated square wave is switched between the ground and +5 volts. The digital remote interface varies the duty cycle of the square wave so it is proportional to the desired temperature. The square wave is fed through a low pass filter and is buffered by an amplifier. The output of the amplifier is a direct current (DC) voltage equals to the average value of the square wave. At zero volts, the set point represents a temperature of 0° C. and at 5 volts, the maximum set point temperature equals to 60° C. If the duty cycle, for example, is 75% , the voltage will be 3.75 volts representing a temperature of 45° C.

In an alternative embodiment of the present invention, the apparatus includes a manual control device and a tankless water heater. The desired temperature set point can be adjusted by the manual control device. The manual control device includes an analog switch and a simple potentiometer.

In another alternative embodiment of the present invention, the apparatus includes a tankless water heater with an adjustable potentiometer for fixed operation. The adjustable potentiometer is fixed at the factory for a set temperature use.

The present invention is not limited to a single lavatory application. It can also be incorporated into multiple lavatories or showers because of its compact tankless design, one pipe plumbing and elimination of the requirement for a thermostatic/pressure balancing valve.

The digital remote interface temperature selection can also be controlled by a remote central computer station.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Described briefly, the present invention is an apparatus for sensing water outlet temperature and for controlling alternating current (AC) power through an on/off mechanism to regulate power to heating elements embedded in a water stream. The capabilities of simple heating elements are tremendously improved through the application of using a microprocessor to perform a proportional (P), integrating (I) and derivative (D) calculation to determine the operating characteristics of a water delivery system and to control the water delivery system.

Figure 1:
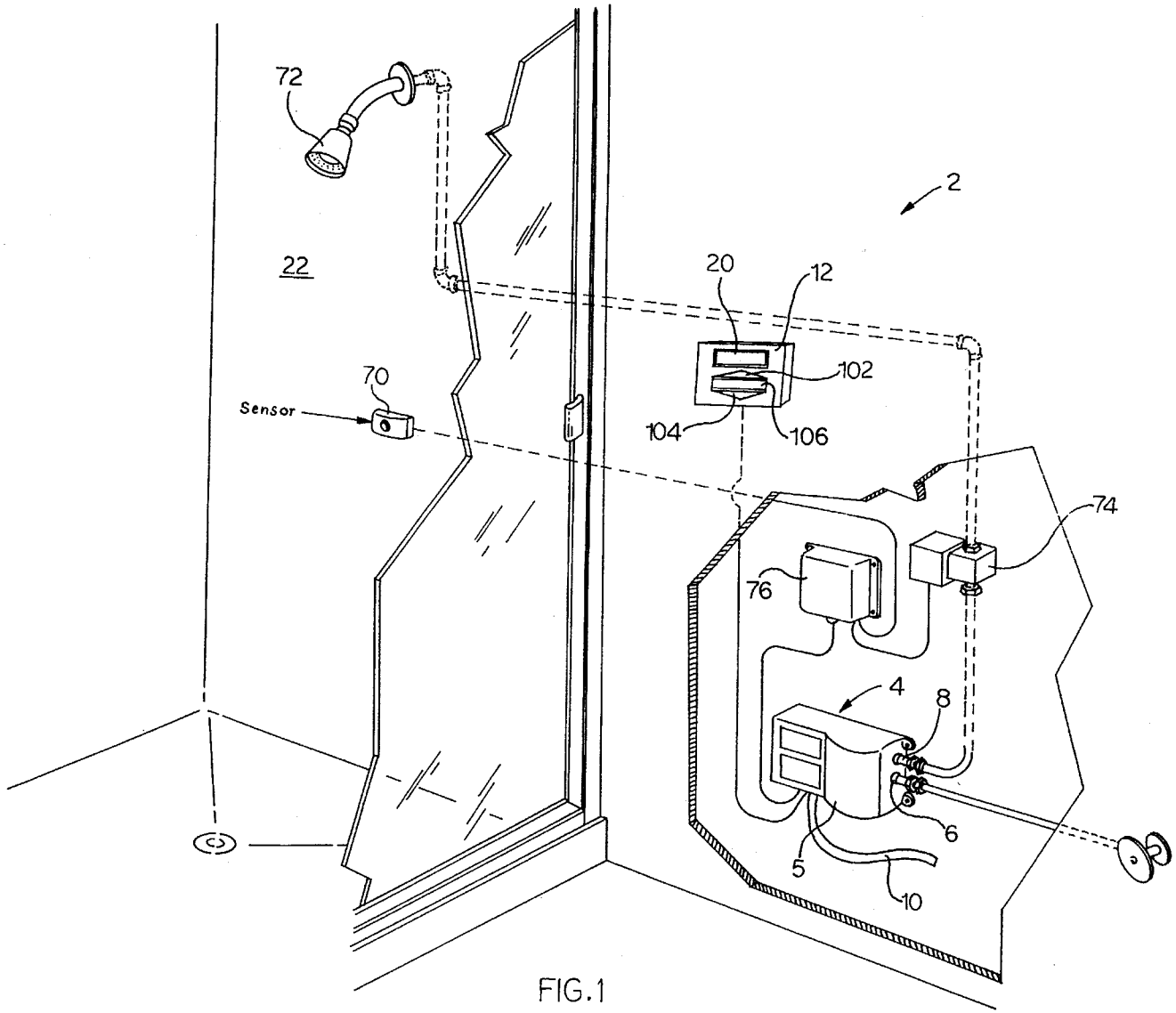
FIG. 1 is an illustrative perspective view of the preferred embodiment of the present invention apparatus for controlling a tankless water heater delivery system utilized in a shower.

Referring to FIG. 1, there is shown a perspective view of the preferred embodiment or sometimes herein referred to as "option 1" of the present invention an apparatus 2 for controlling a water delivery system to obtain precise set point temperatures. Apparatus 2 includes a digital remote interface temperature selection device 12 and a tankless water heater 4. The tankless water heater 4 has a housing 5 with a water inlet 6, a water outlet 8 and a passage (not shown) which is located between the water inlet 6 and the water outlet 8 to permit a continuous flow of water from the water inlet 6 to the water outlet 8. There is also at least one heating element or heating coils 26 (shown as a block box in FIG. 2) which is mounted within the passage of the housing 5 for heating water as it flows through the passage, and electrically connected with electronic control circuitry contained within the housing 5.

In FIG. 1 apparatus 2 is shown being used in conjunction with a shower 22. It will be appreciated that the present invention apparatus 2 is not limited to the shower application as illustrated in FIG. 1. It can be used in lavatory, bathroom sinks and kitchen sinks which allow users of single faucet or mixing faucet installations in offices, hospitals, nursing homes, restaurants and in other industrial/ commercial and residential installations to select their desired water temperature before the water faucet is activated. It must also be appreciated that there are two alternative embodiments of the invention which are disclosed. The first alternative embodiment or as sometimes referred to herein as "option 2" utilizes a remote manual control device containing a potentionmeter and an analog switch (indicated as 37 in FIG. 2). the second alternative embodiment or as sometimes herein referred to as "option 3" does not have a remote control device but is designed to include a pre-set temperature control which is set by the manufacturer.

The housing 5 further includes four connectors (not shown in FIG. 1 but illustrated as J1, J2, J3 and J4 in FIGS. 5 and 7) and a power cable 10 for supplying line power to the electronic control circuitry and heating elements contained within the housing 5.

In the preferred embodiment or option 1 the controllable temperature selection device 12 is conveniently mounted on a wall. The temperature selection device 12 has an up temperature pushbutton switch 102, a down temperature pushbutton switch 104, a cold pushbutton switch 106 and a digital display 20 for displaying the selected temperature, and all electrically connected with electronic selection circuitry contained within the temperature selection device 12. The electronic selection circuitry of the temperature selection device 12 is electrically connected to the electronic control circuitry of the tankless water heater 4.

The apparatus 2 can be used in conjunction with an infrared sensor 70 which is installed in the shower stall 22. The user will first select the desired temperature on the temperature selection device 12 and store the selected temperature in memory. As one enters the shower and approaches the shower head 72, the infrared sensor 70 will detect the presence of him or her and activate a water solenoid valve 74 and activate the tankless water heater 4 to supply the selected hot water to the shower head 72.

If the user while taking a shower or using a lavatory and wishes to turn off the water, he or she can merely step back away from the sensor 70 and it will sense the change. There is also a sensor control box 76 used for controlling the infrared sensor 70 and the water solenoid valve 74. Upon sensor 70 detecting the absence of the user sensor control box 76 will then turn off the water solenoid valve 74 and will turn off the main power to electrical elements and electronics located in the tankless water heater.

The infrared sensor 70, the water solenoid 74 and the sensor box 76 are all off the shelf components. It will be appreciated these components are installed in the conventional manner and it will not be too hard for one skilled in the art to install and integrate these components with the present invention apparatus 2. It will also be appreciated that each of the embodiments can be used with a plurality of showers or lavatories wherein each shower or lavatory is controlled by the controllable temperature selection device and which is in turn controlled by a remote computer controlled central station 55 as illustrated in FIG. 2.

Figure 2:
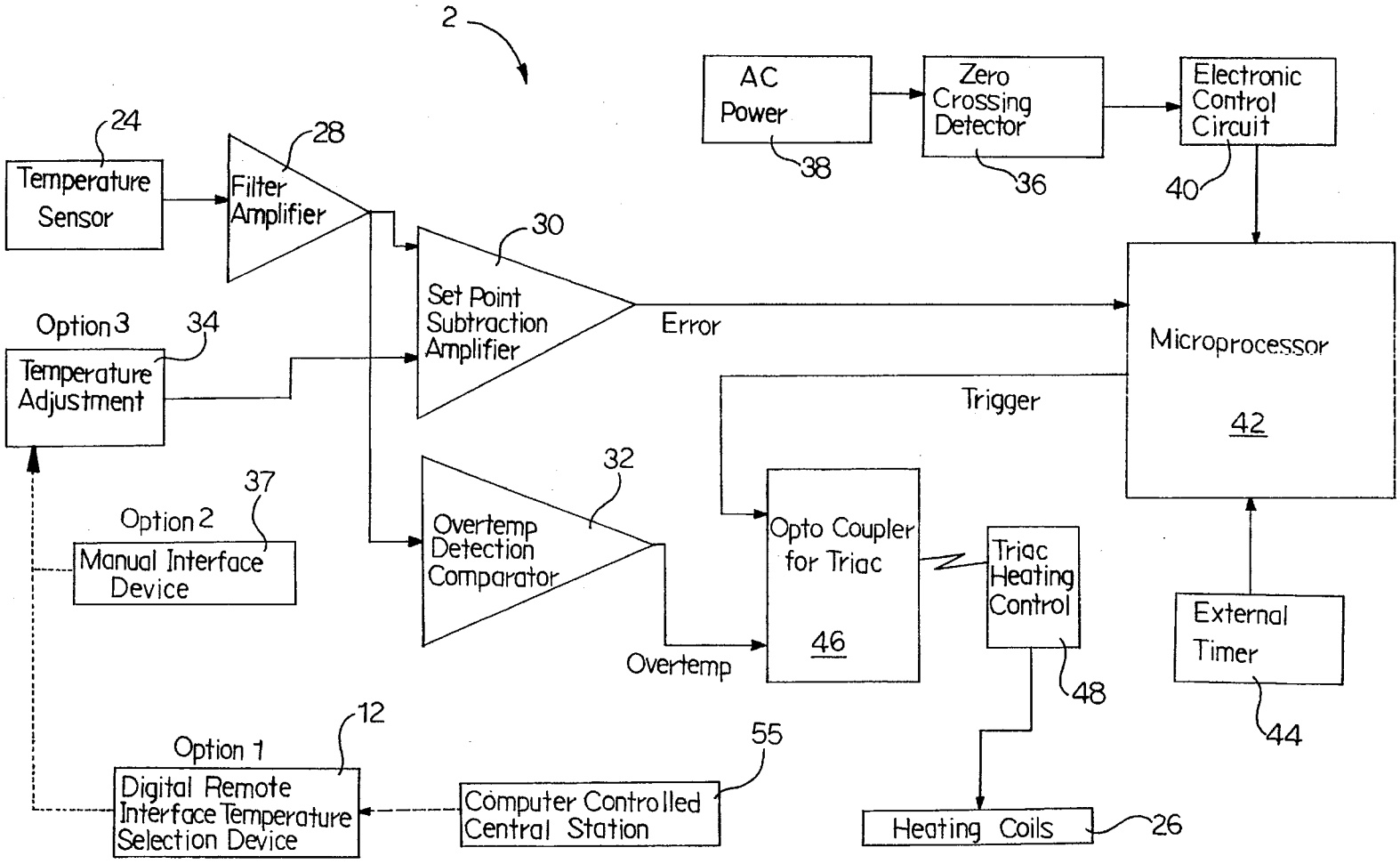
FIG. 2 is a simplified functional block diagram illustrating the function of the preferred embodiment of the present invention apparatus.

Referring to FIG. 2, there is illustrated a simplified functional block diagram of the apparatus 2 for controlling the water delivery system showing three options for selection of the temperature set points. can be set by one of three ways. The first option, which is also the preferred embodiment, of adjusting the temperature set-points is by a digital remote interface temperature selection device 12. The digital remote interface temperature selection device 12 produces a pulse width modulated (PWM) square wave that switches between ground and +5 volts. When a new set point is selected the interface temperature selection device 12 varies the duty cycle of the square wave so that it is proportional to the desired temperature level. The second option, or the alternative embodiment herein, includes a manual control device 37 in place of the digital remote device. It includes a remote potentiometer and an analog switch that can be rotated to the set-point voltage and forces the system to produce the water in a desired temperature. The third option, or the second alternative embodiment herein, is design not to be controllable by the user but for fixed temperature operation. In place of a remote control device a temperature adjustment 34 is preset at the factory so that the hot water temperature cannot be changed.

Within tankless water heater 4 a temperature sensor 24 is located in the water outlet of the water line going to the shower for sensing the water temperature and operable to enable real time sensing of an actual temperature level of the water. The temperature sensor generates a direct current (DC) output voltage signal which is proportional to the actual temperature level.

A filter/amplifier 28 is used for receiving the DC output voltage signal from the temperature sensor 24 for removing electrical noises and for amplifying the DC output voltage signal. In turn filter/amplifier 28 provides an output signal to a set point subtraction amplifier 30 and an over temperature detection comparator 32. A set point subtraction amplifier 30 receives the amplified DC output voltage signal from filter/amplifier 28 and also, depending on the particular embodiment or option, it receives a second input from temperature adjustment 34, or the manual interface device 37 or the digital remote interface temperature selection device 12. The function of subtraction amplifier 30 is to subtract the DC output of amplifier 28 from a value which is proportional to the desired temperature level. In other words the set point subtraction amplifier 30 generates an output error signal representative of the difference between the desired temperature level and the actual temperature level from either the temperature adjustment 37 as in option 3; or the manual remote interface device 37 as in option 2; or, the digital remote interface temperature selection device 12 as in option 1.

The over temperature detection comparator 32 also is connected to the output of filter/amplifier 28 and receives the amplified DC output voltage signal, which it compares with an internal standard voltage. If the actual temperature level, as indicated by the output of filter/amplifier 28 exceeds the internal standard voltage, contained in 32, an over temperature signal is generated. In this event a signal is fed to an optocoupler 46 that disengages the signal output of 46 which in turn shuts down the power to the heating coils 26.

Also illustrated in FIG. 2 is a zero crossing detector 36 is coupled to an alternating current (AC) power signal 38 for generating DC support voltages and for detecting a zero crossing in the AC power source 38. The output of the zero crossing detector 36 is coupled to a comparator 40 for receiving the zero crossing signal to generate an interrupt on transitions of the zero crossing signal.

A microprocessor 42 is connected to the outputs of the set point subtraction amplifier 30 and the comparator 40 and receives the error signal and the zero crossing signal, respectively, to provide a trigger signal. The microprocessor 42 has an internal timer for providing a timing range. The microprocessor 42 is also connected to an external timer 44 for assisting the internal timer of the microprocessor 42 to extend the timing range such that the internal timer and the external timer 44 are used to set the proportionality of the PWM square wave from the digital remote interface temperature selection device 12.

An optocoupler 46 is also connected to the microprocessor 42 for controlling a triac heating control 48. The optocoupler receives the trigger signal to apply full power to heating coils 26 such that the water heats up. As explained previously, the optocoupler 46 may also receive an input signal from the over temperature detection comparator 32 in the event of a fail-safe shutdown of the apparatus 12 by preventing the optocoupler 46 from turning the triac heating control 48 on. With power removed from the triac 48, the heating elements 26 cools less than ½ AC cycle and the outlet water temperature returns to a safe value.

Figure 3:
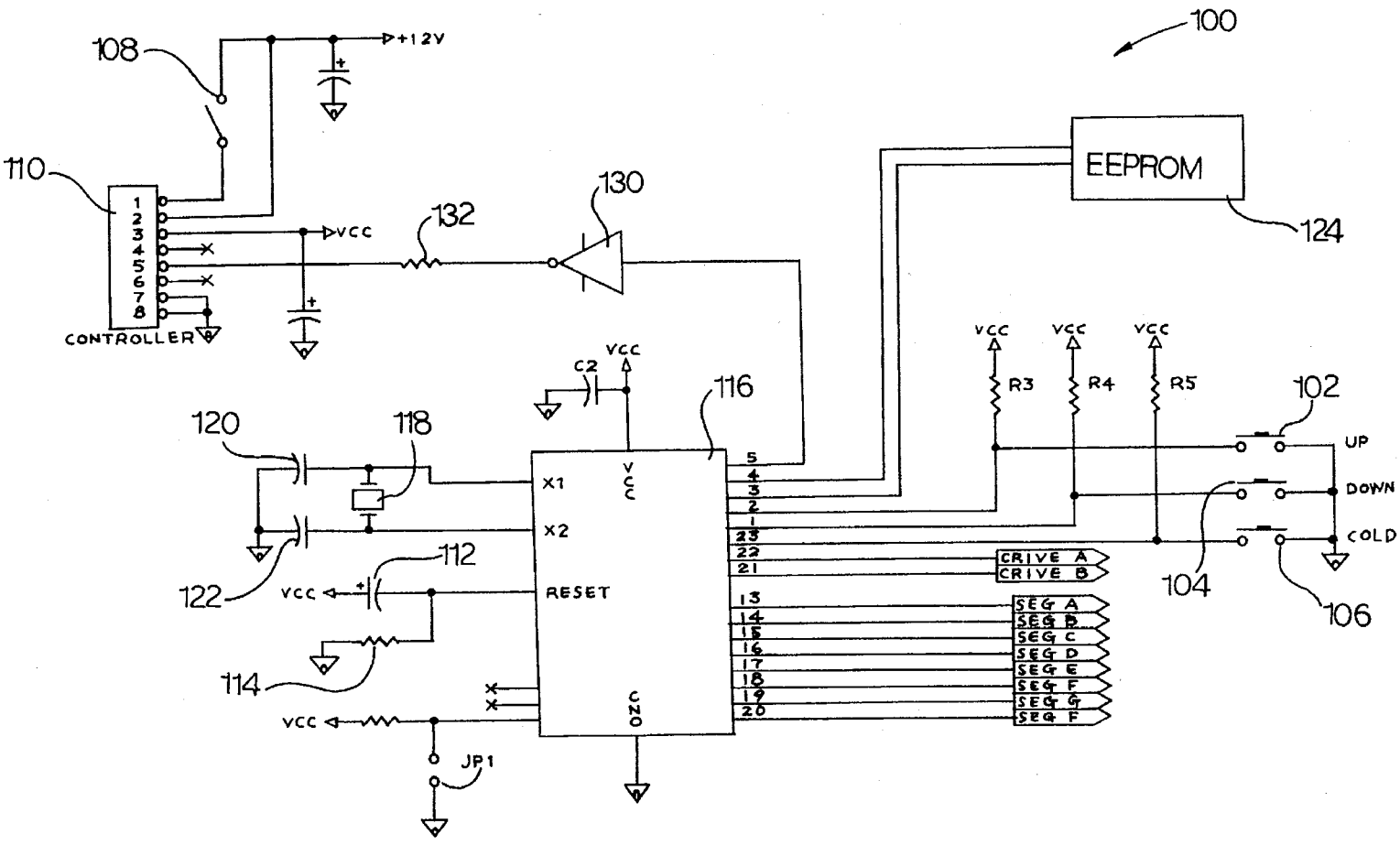
FIG. 3 is a first part of a detailed electronic circuitry diagram of the digital remote interface temperature selection device.
Figure 4:
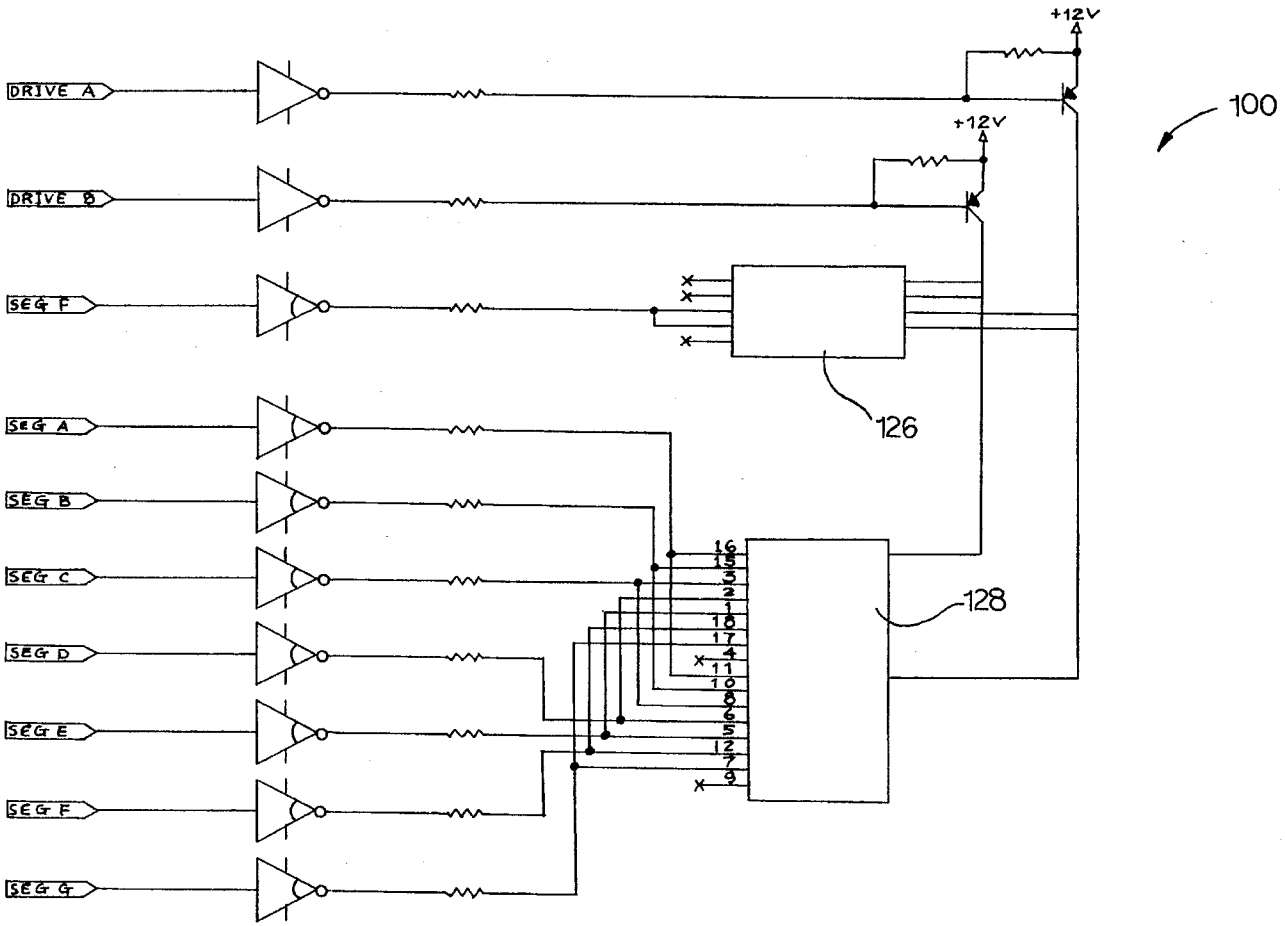
FIG. 4 is a second part of a detailed electronic circuitry diagram of the digital remote interface temperature selection device.

Referring now to FIGS. 3 and 4, there is illustrated a detailed schematic diagram of the digital remote interface electronic selection device 100 which is a portion of the preferred embodiment or option 1. FIG. 3 illustrates the first part of the circuitry 100 and FIG. 4 illustrates the second part of the circuitry 100. It will be appreciated that the circuit is but one of many circuits which could be devised to create the digital remote interface temperature selection device, and is not limited to only this embodiment. The circuit can be easily constructed from off the shelf components.

The purpose of a interface temperature selection device is to generate a reference voltage which represents a desired temperature selected by a user. In the preferred embodiment or option 1 electronic circuitry with an digital-to-analog (D/A) convertor and cascaded up/down counters are used to set the reference voltage.

The electrical interface between the digital remote interface temperature electronic selection circuit 100 and the tankless water heater 4 is connected through a connector 110. In use tankless water heater 4 is connected to AC power and 12 volts DC is present on pin 1 of the connector 110. Tankless water heater 4 is activated when a switch 108 is closed by the user and 12 volts is applied at pin 2 of the connector 110. With the switch 108 closed the tankless water heater 4 generates 5 volts DC which is applied to pin 3 of the connector 110. The 5 volts power bus is generally indicated in FIGS. 3 through 7 as Vcc. Prior to switch 108 being closed capacitor 112, shown in FIG. 3, initially is discharged. When the user closes switch 108 capacitor 112 charges through a resistor 114 and creates a positive going reset pulse to a microcontroller 116. This initializes the microcontroller 116 and allows an oscillator which is formed by a crystal 118, and capacitors 120 and 122 to properly start before the program begins executing.

A non-volatile electrically erasable programmable read only memory (EEPROM) 124 has a two wire serial interface. The two wire are serial data (SDA) and serial clock (SCL). Upon power up, the microcontroller 116 will read the data stored in the EEPROM 124. The data will include the last temperature setting, and the minimum and maximum allowable temperature settings. Additional data may be stored in the EEPROM 124 which could include centigrade/fahrenheit display selection, calibration factors, a serial number and factory tracking codes. A code may also be included to enable data integrity checking.

The microcontroller 116 also monitors the three pushbutton switches 102, 104 and 106 which control the water temperature setting. The remainder of the output lines which are labeled as SEG A through SEG F drive the digital display. The range of numbers which can be displayed can be from 0 to 199. The data stored in the EEPROM 124 can limit the allowable temperature settings to be less than that range.

The electronic selection circuitry 100 utilizes an LED display. It is possible that a liquid crystal display (LCD) other type of display may be used. The display circuitry is multiplexed. This means that at any instant, only one numeral is on at a time.

As shown in FIG. 3 the ones digit is enabled when the DRIVE A line from the microcontroller 116 is high. During this time, the proper bit sequence will appear on pins 13 through 20 of the microcontroller 116 to display the appropriate number. A short time later, the DRIVE A line will be set low and the tens digit will be enabled by setting the DRIVE B line to high. The bit pattern on pins 13 through 20 of the microcontroller 116 will change as required for the tens digit. The hundreds digit can only be a number 1 or off. The number 1 is made up of two LED segments 126 and 128. These segments 126 and 128 are both tied to pin 20 of the microcontroller 116 which is labeled SEG F. The upper segment 126 of the hundreds digit is enabled along with the ones digit. The lower segment 128 is enabled with the tens digit.

When the remote interface electronic selection circuitry 100 is powered up, the microcontroller 116 will momentarily display 188 so that the user can verify that all display segments are functional. Then, the last temperature setting will be displayed. If the user desires another temperature the user presses either the up pushbutton switch 102 or the down pushbutton switch 104 such that the display value will increment or decrement. If the user presses and holds the pushbutton for more than three seconds, the value will change rapidly. If the user presses the cold pushbutton switch 106, the display will indicate "LO". Each time the temperature setting is changed, the current setting will be written to the EEPROM 124. Once the user has selected a temperature, a corresponding DC voltage is fed to a D/A converter, located in microcontroller 116. The D/A converter is a pulse width modulator (PWM) which outputs a pulse on pin 5 of microcontroller 116 at a fixed frequency, such as one kilohertz. If this is the case, a pulse output will occur once every millisecond. The pulse is buffered and inverted by a hex inverter 130. A resistor 132 helps match the impedance between the interconnecting cable to and the input to inverter 130.

Figure 7:
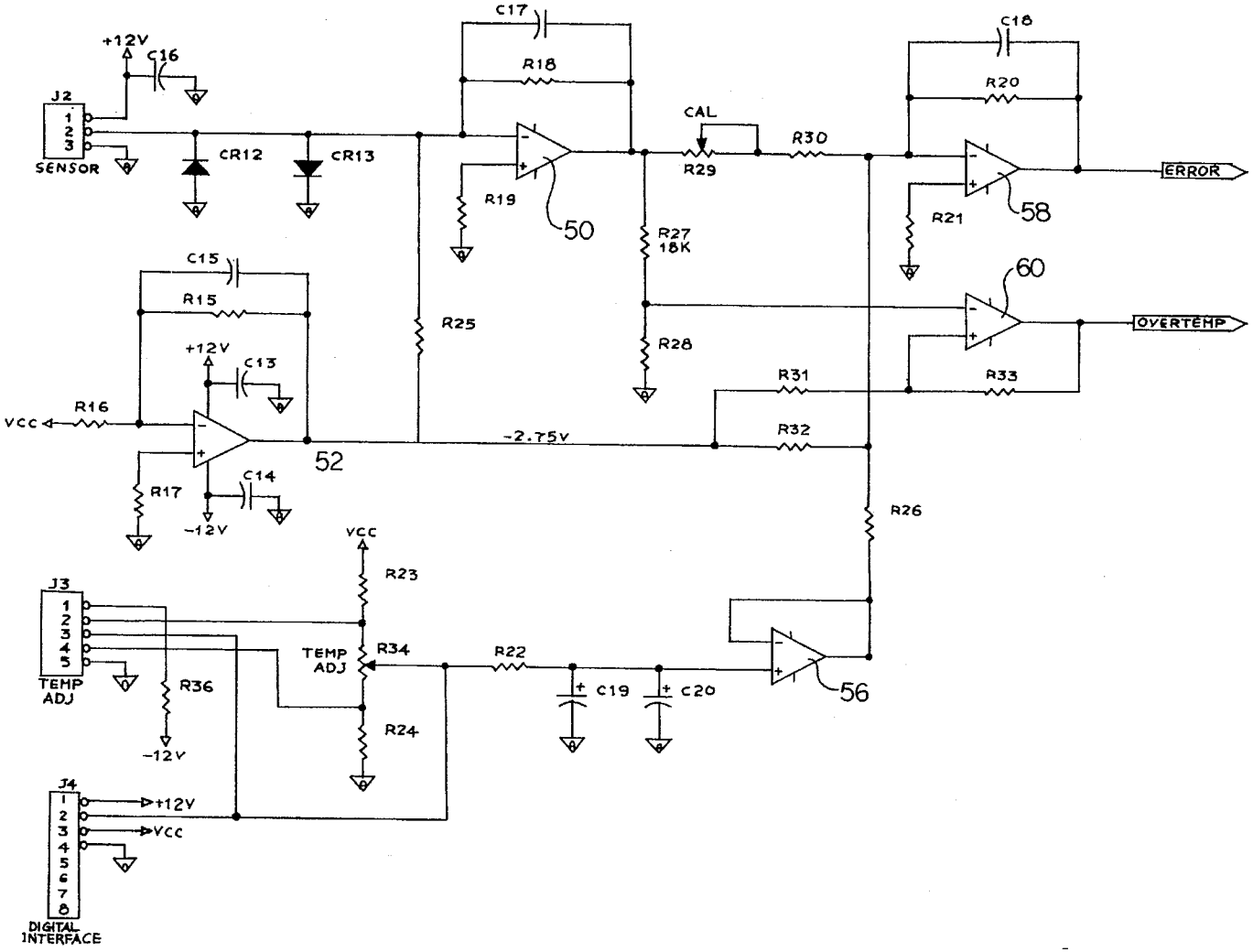
FIG. 7 is a third part of a detailed electronic circuitry diagram of the tankless water heater.

The width of the pulse from pin 5 of the microcontroller 116 will vary depending on the temperature setting. If 0° C. is selected, the pulse width will be 1 millisecond. Since the pulse rate is also 1 millisecond, pin 5 of the microcontroller 116 will be continuously high. The reference signal as inverted by the hex inverter 130 will be zero. If 37.78° C. is selected, the desired voltage is 3.15 volts which is 63% of 5 volts. The pulse width from pin 5 of the microcontroller 116 will be 0.37 milliseconds. The reference signal at pin 5 of the connector 110 will be high ( 5 volts) for 0.63 milliseconds and low (0 volts) for 0.37 milliseconds. The waveform will be fed through a low pass filter as shown in FIG. 7, which includes a resistor R 22 and capacitors C19 and C20, on the tankless water heater 4. The output of the filter will equal the average value of the pulse width modulated signal, that is, 63% of 5 volts which is 3.15 volts or equalivalent to the desired analog voltage. The cutoff frequency of the low pass filter is approximately 3 Hz. With a modulation frequency of 1 KHz, the maximum residual ripple voltage is 1.7 millivolts peak to peak.

When the cold pushbutton switch 106 is pressed, the PWM output voltage will be the same as 0° C. When a jumper JP1 is closed, the program enters the calibration mode. The pushbutton switches 102, 104 and 106 may then be used to enter all factory defined parameters.

Figure 5:
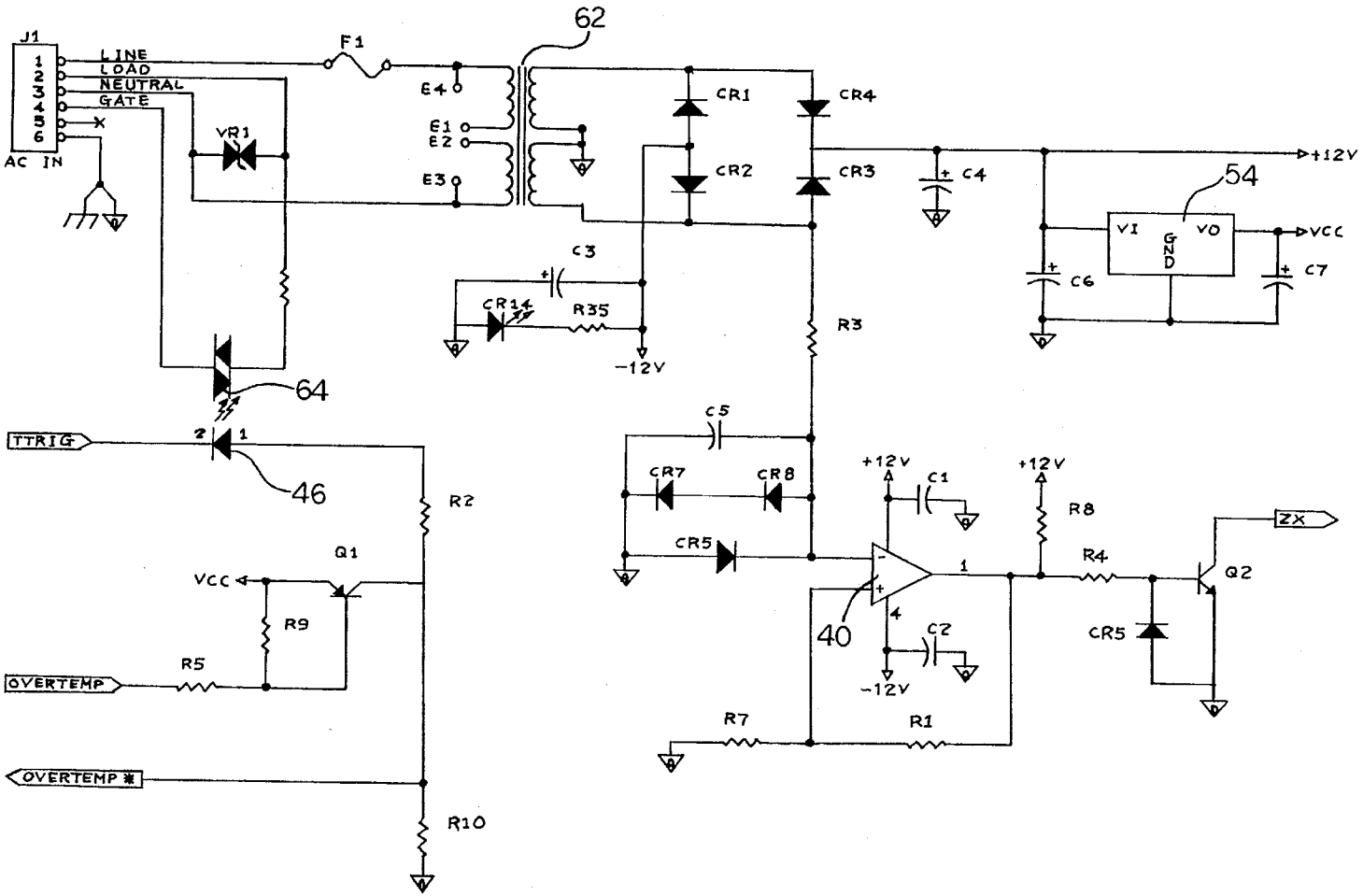
FIG. 5 is a first part of a detailed electronic circuitry diagram of the tankless water heater.
Figure 6:
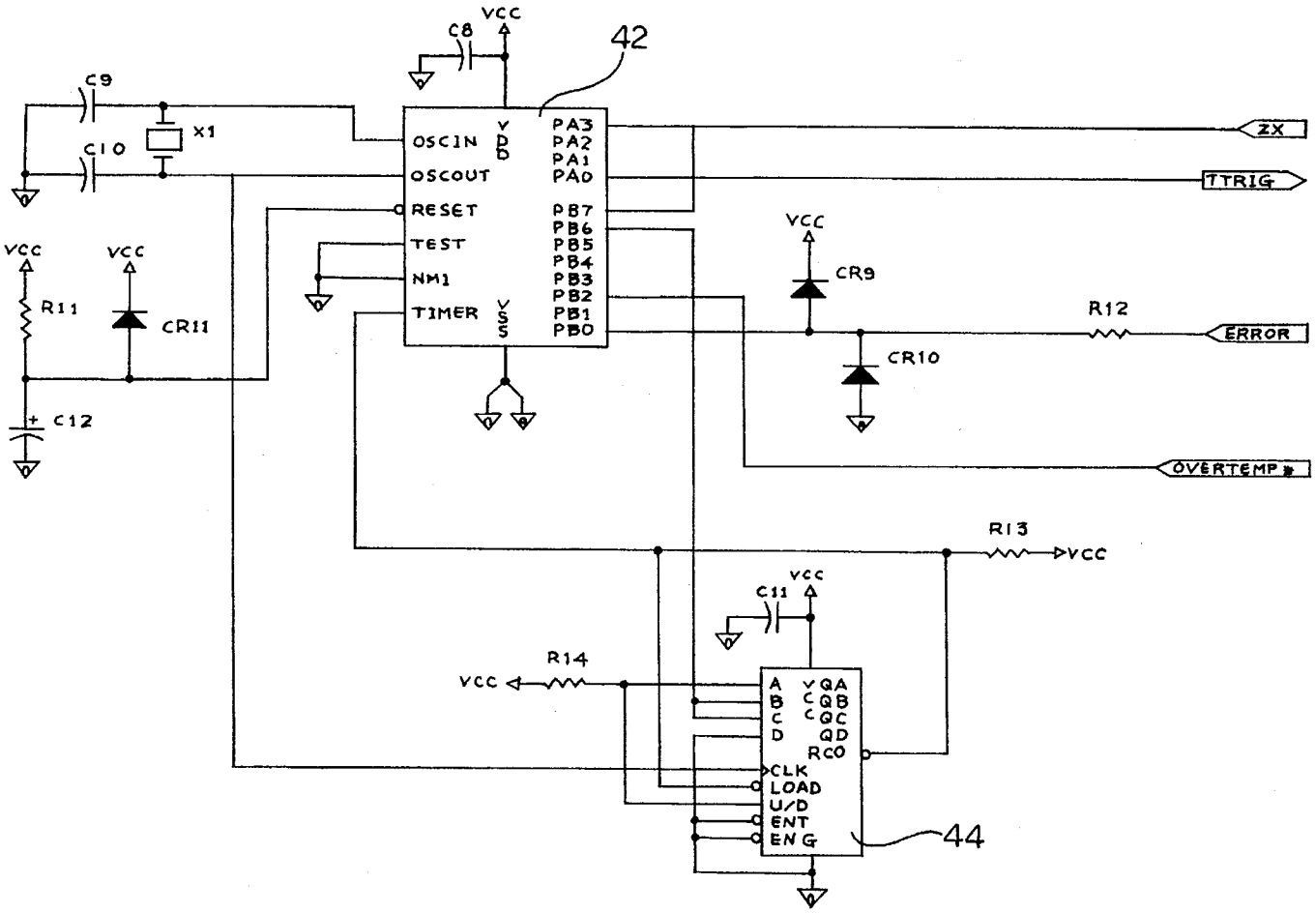
FIG. 6 is a second part of a detailed electronic circuitry diagram of the tankless water heater.

Referring now to FIGS. 5 through 7, there is illustrated a detailed schematic diagram of the electronic control circuitry contained within the housing of tankless water heater 4.

The remote interface electronic selection circuitry of the digital remote interface temperature selection device generates a pulse width modulated square wave which switches between ground and +5 volts and appears at pin 2 of connector J4 shown in FIG. 7. The square wave is fed through a low pass filter which includes a resistor R22, capacitors C19 and C20 and is buffered by an amplifier 56. The output of amplifier 56 is a DC voltage equal to the average value of the square wave. If the duty cycle, for example, is 75%, the voltage at the output of the amplifier 56 will be 3.75 volts representing a temperature of 45° C. It should be noted that, if either the digital remote interface temperature selection device (option 1) or the manual analog switch (option 2) are used, a resistor R34 is not installed. This component is only used in option 3 where no remote interface control is used and the water temperature is preset by the manufacturer.

Option 2 or the alternative embodiment includes remote interface containing a manual analog with a simple potentionmeter which is connected to a connector J3. When the manual analog switch is rotated to the full counterclockwise position the analog switch shorts out the set-point voltage being fed to low pass filter in FIG. 7 and forces the system to produce cold water.

In the second alternative embodiment or option 3 the temperature is preset at the factory. The trimmer potentiometer R34 is designed for fixed temperature operation. The trimmer potentiometer R34 is fixed at the factory. Resistors R23 and R24 are used to set the upper and lower set-point limits for either the internal potentiometer or the manual analog switch.

The remote temperature sensor 24, shown in FIG. 2 is connected at connector J2 of the electronic control circuitry shown in FIG. 7. The remote temperature sensor is a two-terminal integrated circuit type AD590 manufactured by Analog Devices. The remote temperature sensor is a current source with an output directly proportional to absolute temperature. The remote temperature sensor exhibits a high impedance and this is insensitive to voltage drops over long lines. The high output impedance which is greater than 10 MΩ which also provides excellent rejection of supply drift and ripple.

Referring now to FIG. 7, the input on pin 2 of connector J2 is fed to a differential amplifier 50 which is configured as a transimpedance amplifier. The output from amplifier 50 is a negative voltage which is subtracted from the positive set point voltage being fed by buffer amplifier 56. The difference is amplified by a gain of 4 by an amplifier 58. When the temperature voltage and set-point voltage are equal, the error signal at the output of amplifier 58 is zero. Thus, the error signal can move in either a positive or negative direction. However, since an analog-to-digital (A/D) converter in the microprocessor 42 cannot digitize negative voltages, an offset of 2.5 volts is provided by resistor R32, as shown in FIG. 7. If the error signal is greater than 2.5 volts, the temperature is too high and the triac trigger must be delayed. Conversely, if the error is less than 2.5 volts, the temperature is too low.

As shown in FIG. 7 a potentiometer R29 calibrates the remote temperature sensor and compensates for gain and offset errors due component tolerances. This is a single point calibration. It will be accurate at the particular calibrated temperature, but the accuracy will diminish as the temperature changes from this point. The largest source of error is due to the 5 volts linear voltage regulator 54 as shown in FIG. 5. It should be noted that it is critical to the operation of the error circuit that a constant voltage is maintained. The voltage is used both as a reference for the A/D converter and is scaled to represent 0° C. The maximum initial tolerance is ±5% and the typical drift is −0.6 mV/° C. Under worst case conditions, a variance of the −2.75 voltage reference from −2.55 to −2.95 volts can be tolerated. In other words, the 20° C. reference can vary from −18° C. to +22° C. If the system is calibrated to produce 3.75 volts at 45° C., an ideal amplifier output would be zero at 0° C. and 5 volts at 60° C. Due to variations in the voltage regulator output, however, the error becomes significant as the temperature moves away from 45° C. The error can be eliminated by replacing resistor R25 with a combination of a fixed resistor and a trimmer potentiometer.

Another source of error is ambient temperature related drift. The typical temperature coefficient of the regulator is −0.6 mV/° C. In other words, if the ambient temperature increases by 10° C., Vcc will decrease by 60 mV. This will shift the measured temperature by approximately 3° C.

Referring now to FIG. 5 a line voltage is fed to transformer 62 is a bridge rectified by diodes CR1 through CR4. The positive and negative 12 volts signal is taken from the rectifiers and used by the rest of the electronic control circuitry and the digital remote interface electronic selection circuitry 100 of the digital remote interface temperature selection device. A portion of the positive 12 volts supply is fed to the voltage regulator 54. The voltage regulator 54 provides +5 vdc or Vcc for the microprocessor 42 and various other circuits. A filter capacitor C7 at the output of the voltage regulator 54 removes AC ripple from the supply voltage.

Turning to FIG. 7 the filter/amplifier 28 (shown in FIG. 2) includes a capacitor C17, resistors R18 and R19, and the differential amplifier 50. The gain of the transimpedance amplifier 50 is set by resistor R18 and is equaled to 82,500 volts/amp. The output of the amplifier 50 is then 82.5 mV/° K. During normal operation, the input of the amplifier 50 will be at zero volts. Diodes CR12 and CR13 protect the input from static discharge.

In order to optimize dynamic range, the input signal to differential amplifier 50 is converted to be proportional to degrees centigrade rather than kelvin. To do this, 273 μA must be subtracted from the current input. In order to accomplish this a reference of −2.75 volts is generated by a differential amplifier 52 being derived from the 5 volt linear voltage regulator 54. Since the input of the amplifier 50 is zero volts, 2.75 volt s appears across resistor R25. By way of example only, R25 is a precision 10.O Kμ resistor which pulls a current of 275 μA away from the input of the amplifier 50. With the temperature sensor at 0° C., the input current will be balanced by this offset current and the output of the amplifier 50 will be effectively at zero.

As shown in FIGS. 2, 5, 6 and 7, in operation the remote temperature sensor supplies a DC voltage to filter/amplifier 50 which varies with water temperature at the output of tankless water heater 4 amplifier 50 filters the temperature sensor signal to remove electrical noises and then amplifies the signal by a factor of 80,000. The output of the amplifier 50 is a voltage proportional to the absolute temperature of the water from the tankless water heater. The amplified voltage is then fed to over temperature detection comparator 60 and to the set point subtraction amplifier 30. The set point subtraction amplifier includes a differential amplifier 58, a capacitor C18, and resistors R20 and R21. The amplifier 58 receives the temperature sensor voltage and subtracts it from a value proportional to the voltage setting coming from either digital remote selection device 12 (option 1) or manual interface device 37 (option 2) or temperature adjustment control R34 (option 3). The resulting error signal is the primary input signal to the microprocessor 42 (as shown in FIG. 6). The error signal is proportional to the difference in desired water temperature and that present at the outlet of the water heater at any given time.

Because an external subtraction unit is used, an additional amplification of 4 can be used in the amplifier 58 without exceeding the input range of the microprocessor's A/D converter.

The temperature sensor voltage from the amplifier 50 is also fed to a comparator 60. The comparator 60 compares the temperature signal with an internal standard voltage formed by resistors R15 and R16. If the temperature signal exceeds the internal standard voltage, then an over temperature signal is generated. This alerts the microprocessor 42 that the temperature exceeds the maximum limits. Also, comparator 60 provides a fail-safe shutdown of the system by preventing the enablement of triac 64. With power removed from triac 64 in FIG. 5, the heating elements cool within ½ AC cycle and the outlet water temperature returns to a safe value.

Turning now to FIG. 5 a transformer 62 couples line voltage to the electronic control circuitry 40 for detecting a zero crossing of the AC line. The zero crossing is important because the output of the triac 64 will shut off and terminate heating elements whenever the AC signal crosses zero. The microprocessor 42 takes this shut off into account in computing the length of power-on time needed to keep the water at the proper desired temperature. A network of diodes CR7, CR8 and CR9, capacitors and resistors filter and clean the incoming AC signal. It is important to reduce noise in determining the exact point that the AC line cross zero voltage. Resistor networks R1 and R7 provide hysteresis to further reduce false triggering by a comparator 40. The comparator 40 essentially converts the incoming AC signal into a fast rise square wave. The fast leading and trailing edges of this square wave are fed to the microprocessor 42 and generate an interrupt on the transitions of zero crossings.

The external timer 44, shown in FIG. 6, augments an internal timer of the microprocessor 42 and serves to extend its range. Pins B and C are presetting inputs which adjust the rate of the external timer 44 in order to assist the microprocessor 42 in adapting to 50 or 60 Hz AC line frequencies. This selection is made under control of the microprocessor 42 internal program.

Microprocessor 42 contains an oscillator which signal is fed to external timer or prescaler 44 at pin "CLK". External timer 44 also receives an output voltage from pin "PB6" of microprocessor 42 which is high or low depending upon whether 50 or 60 HZ AC line voltage is being used. When pin PB6 is high the line voltage is about 60 HZ. In this case external timer 44 is pre-programmed to divide the frequency on pin CLK by a factor of 15. If the line frequency had been 50 Hz, then the microprocessor would have divided the oscillator by 9. In addition the same frequencies are again divided by an internal timer in microprocessor. For a 60 Hz line frequency the division is by 8 and for a 50 Hz the division is by 16. The result of this division, a resulting signal of 61,440 for 60 Hz and 51,200 for 50 Hz is then sent to a count down register. It should be noted that the resulting frequency will not vary in changes in line frequency. This is important because the resulting frequency is critical for the system's accuracy in determining the turn on point for triac 64. This is essential for maintaining absolute temperature control despite noise and line frequency variations.

The combination of the internal timer of the microprocessor 42 and the external timer 44 are used to set the proportionality of the pulse width modulation (PWM) of the basic proportional (P) portion of the PID controls as follows: at a zero crossing, the output of the triac 64 is turned "off"; the system waits for the amount of time in the external timer 44; and, it then turns "on" the output of the triac 64. The triac 64 then remains "on" until the next zero crossing. Therefore, the value set in the external timer 44 determines the proportion of the "on" to "off" time for the system. This proportionality can be adjusted by setting different values into the external timer 44. The values are calculated using an advanced PID algorithm.

When the microprocessor 42 in FIG. 6 determines that it is time for the "on" portion of the proportional control, it sets its trigger signal or "TTRIG" (from pin PAO of microprocessor 42) "on". If trigger signal is "on", then current flows through the light coupled device shown in FIG. 5. Optocoupler 46 is then coupled the trigger signal via optoelectronic isolation to triac 64. The triac 64 shunts the full power of the AC line (up to 9 kw) into the heater elements and the water heats up. Ultimately the temperature rise is detected by the remote temperature sensor and thus, the system loop is closed and controlled by the microprocessor 42.

The optocoupler serves to decouple the sensitive of the microprocessor 42 and other control circuitry from the large power control circuitry represented by transistor Q1. The trigger signal from the microprocessor 42 to the optocoupler cannot turn "on" the triac 64 unless the output of the comparator 60 is low, indicating a safe range of operation.

The PID operation of the water delivery system (controller) is performed by software permanently etched into the microprocessor's control store.

The equation for PID control consists of three terms which are described below. The algorithm description includes a proportional term, an integral term and a derivative Term. The proportional term is a gain constant $K_p$ times the error signal. The error signal is proportional to the difference between the desired temperature and the actual temperature. The integral term consists of the integral constant $K_p$ times the integral of the error signal over the time period since starting to the current time. The derivative term consists of the derivative constant $K_p$ times the current rate of change of the error signal.

The loop equation for the PID loop is then: output=$K_p$* (error)+$K_i$* sum (error)+$K_d$(error)/dt
where:

$K_p$ is the proportional constant;

$K_i$ is the integral constant; and $K_d$ is the derivative constant.

The proportional term is a constant gain for the system. This gain is a compensation for the losses, including heat loss to the device itself, as well as to the surrounding air and the flowing water.

The integral term adds up cumulative errors until these errors get large enough to require a reversal in "direction" (i.e. add more power or reduce the power). It is this term which causes ringing or oscillation of a system.

The derivative term introduces a dampening effect. This term will anticipate the ringing of the system and will attempt to cancel the effect of the ringing.

When a system with only proportional control is off the specified set point, the controller will increase the control voltage until the error signal is zero. The system thus returns to the set point with more applied voltage than is required for maintaining equilibrium. This causes overshoot and underdamped ringing. The derivative term contributes proportionally, to the error rate of change, but with the opposite sign of the proportional term. The role of the integral term is to eliminate steady state error.

The heater controller may have to operate in an industrial environment or in other electrically very noisy situations. Use of the triac causes fast switching transients when the triac turns on a heater element with almost 9 kilowatts of power. The turn-off always occurs at zero crossing, so no noise is generated at turn-off.

In addition to the noise sources present on AC lines, There may be serve distortions of the normal sinusoidal shape of the AC line. These distortions may be caused by heavy industrial machinery and/or load transients.

The controller must accurately turn-on of the triac at a computed segment of the AC cycle. This turn-on occurs every ½, cycle of every 8/1000 of a second. The controller seeks to adjust the power to the nearest computational step of 1 part in 128. The required time accuracy is then 1/128 times 8/1000 seconds or 1/16,000 of a second.

The control of the triac turn-on is made by sensing the zero crossing of the AC line (when the AC line voltage passes through zero volts). Following the zero-crossing, the microprocessor counts off the time interval to the nearest 1/128 of a ½ cycle as described above. The triac is then turn "on" and left on until the next zero crossing.

If the microprocessor 42 receives a pulse and misinterprets it as a zero crossing, the triac could be triggered in error and then the wrong time interval will have been used for the power-on cycle. Through its PID algorithm, the controller program can still correct a systematic error and still achieve the right control temperature. The correction would only work if the error occurs at the same place in the AC cycle each time. If the error occurs at different points in the cycle and varies widely from cycle to cycle, the controller output temperature would also widely vary.

To reduce the effects of noise, the microprocessor program introduces a zero crossing lockout window. This window locks out the recognition of any new zero crossing, once the first crossing is seen. The programmed window continues to lock out future zero crossing detections even though the electronic circuitry may signal one or more. The lockout continues using the internal timer until about ¾ of the AC ½ wave has passed. At the end of the timed interval, the lockout window is opened by the program to new zero crossing detections. The next zero crossing detected will start the lockout cycle over again.

The lockout window reduces the sensitivity of the controller to noise by completely ignoring extra pulses during a major portion of the AC ½ cycle time period.

If the cycle started with a false noise pulse, there is a good chance that the program will lock out further false pulses. When the lockout window opens, the next zero crossing restarts the timer. The window stays open until a new true zero crossing. If the first pulse was noise, it may take a little extra time before the new true zero crossing occurs. Once a true zero crossing is captured, the controller will tend towards opening the window just in time to capture the next true zero crossing. In this manner, the controller synchronizes itself with the true AC line frequency and zero crossings and locks out and ignores the false ones.

The algorithm computes the time between two successive zero crossings and determines whether the AC cycle is closer to a 50 or 60 Hz value. The appropriate time constant is then fed to the external time divider and the internal timer microprocessor countdown. The main control loop includes the following steps:

1. Wait for zero crossing interrupt;
2. Output PWM (delay) value to timer. Power will be turned on to the heater at the end of this delay;
3. Read the current temperature error signal by cycling the A/D converter.

Call the value thus obtained, "error";

4. Calculate the Proportional Term by P=error * $K_p$;
5. Calculate the Integral Term by I=I +sum(error) * $K_i$;
6. Calculate the Derivative Term by D=error * $K_d$/delta-time;
7. Calculate a new PWM term by adding P+I +D. The result is scaled by constants to reflect the physical dimensions of the heater, time responses and other physical issues; and
8. Retain the new PWM for setting the timer after next zero crossing detection (see step 1).

The integration can be performed by saving the previous "n" samples of the temperature differences in an array. As each new value is read, the oldest value is discarded. The integral can be obtained by summing the last "n" error terms.

The derivative can be performed by using the previous "n" samples of the temperature differences stored in the integration array of step 6. The derivative can be obtained by taking differences using values in that array divided by the time span covering the differences. This calculation and the integral calculations are aided because the temperature is sampled at uniform intervals at zero crossing detection. During start up, the error term in step 3 will be very large. The algorithm will quickly force the power levels to a sufficiently high value to rapidly heat the incoming water. The start up operation is further aided by the initial estimate of the proper PWM value based on the 0.4 gallon/minute estimate of flow rate. Defined in detail, the present invention is an apparatus for controlling a water delivery system to obtain precise set point temperatures and used in conjunction with a shower having means for detecting a person presence in the shower, the apparatus comprising:

a. a housing having a water inlet, a water outlet and a passage between the water inlet and the water outlet to permit a continuous flow of water from the inlet to the outlet;

b. at least one heating element mounted in said passage of said housing for heating water as it flows through said passage, and electrically connected with electronic control circuitry contained within said housing;

c. a controllable temperature selection device for selecting a desired temperature of the water;

d. said temperature selection device further comprising:

(i) an up temperature button, a down temperature button and a cold button, all electrically connected with electronic selection circuitry contained within said temperature selection device;

(ii) said electronic selection circuitry further including a microcontroller having an digital-to-analog (D/A) converter for outputting a pulse width modulated (PWM) square wave proportional to said desired temperature and outputting a bit pattern representing said desired temperature;

(iii) an electrically erasable programmable read only memory (EEPROM) for storing said desired temperature, where each time said desired temperature is changed, it is written into the EEPROM;

(iv) a light emitting diode (LED) display receiving said bit pattern for displaying said desired temperature on a digital display; and e. a remote temperature sensor in fluid communication with the water for sensing a water temperature at said water outlet of said housing and operable to enable real time sensing of an actual temperature of the water and generating a direct current (DC) output voltage signal proportional to the actual temperature;

f. a filter/amplifier for receiving said DC output voltage signal from said remote temperature sensor to remove electrical noises and amplifying said DC output voltage signal;

g. a set point subtraction amplifier connected to said filter/amplifier and said temperature selection device for receiving said amplified DC output voltage signal and subtracting it from a value proportional to said desired temperature, and generating an output error signal representative of a difference between said desired temperature and said actual temperature;

h. an over temperature detection comparator also connected to said filter/amplifier for receiving said amplified DC output voltage signal and comparing it with an internal standard voltage, and generating an over temperature signal when said actual temperature exceeds the internal standard voltage;

i. a zero crossing detector coupled to an alternate current (AC) power signal for generating DC support voltages, and for detecting a zero crossing signal of the AC power signal;

j. a comparator coupled to said zero crossing detector for receiving said zero crossing signal to generate an interrupt on transitions of said zero crossing signal;

k. a microprocessor connected to said set point subtraction amplifier and said comparator for receiving said error signal and said zero crossing signal to provide a trigger signal, the microprocessor having an internal timer for providing a timing range;

l. an external timer connected to said microprocessor for assisting said internal timer to extend said timing range such that said internal timer and the external timer are used to set the proportionality of said PWM square wave;

m. said microprocessor being programmed for constantly calculating a proportional (P) term, an integral (I) term and a derivative (D) term based on an algorithm to determine operating characteristics of said trigger signal;

n. said algorithm including a loop equation utilizing a proportional constant $K_p$, an integral constant $K_i$ and a derivative constant $K_d$ which reflect physical dimensions of said water delivery system and said at least one heating element, said algorithm performing the functions of:

(i) waiting for said interrupt of said zero crossing signal;

(ii) calculating said proportional term which is said error signal times said proportional constant $K_p$;

(iii) calculating said integral term which is said integral constant $K_i$ times the integral of said error signal over said timing range;

(iv) calculating said derivative term which is said derivative constant $K_d$ times the current rate of change of said error signal;

(v) calculating a new PWM term by adding said P+I+D, such that the result is scaled by said constants;

(vi) retaining said new PWM term for setting said internal and external timers after a next interrupt of said zero crossing signal;

(vii) said new PWM term determines said operating characteristics of said trigger signal from said microprocessor; and p. an optocoupler connected to said microprocessor for receiving said trigger signal and forcing full power of said AC power signal into said at least one heating element heat up the water; and o. said optocoupler also connected to said over temperature detection comparator and the optocoupler containing a triac and a light emitting diode (LED).

q. An over temperature signal to provide a fail-safe shutdown of said water delivery system by preventing the optocoupler from turning the triac "on" such that with power removed from the triac, said at least one heating element cools within less than one half AC cycle and said outlet water temperature returns to a safe value; and, r. whereby said microprocessor ensures that said characteristics of said trigger signal is quickly determined to quickly force the power levels to a sufficiently high value so that the incoming water can be heated rapidly.

Defined broadly, the present invention is an apparatus for controlling a water delivery system to obtain precise set point temperatures, the apparatus comprising:

a. a housing having an inlet, an outlet and a passage between the inlet and the outlet to permit a continuous flow of water from the inlet to the outlet;

b. at least a heating element mounted in said passage of said housing for heating water as it flows through said passage, and electrically connected with electronic control circuitry contained within said housing;

c. means for selecting a desired temperature of the water and generating a pulse width modulated (PWM) square wave proportional to the desired temperature;

d. a temperature sensor in fluid communication with the water for sensing an actual temperature of the water at said outlet of said housing and generating a direct current (DC) output voltage signal proportional to the actual temperature;

e. a first amplifier for receiving said DC output voltage signal from said temperature sensor to remove electrical noises and amplifying said DC output voltage signal;

f. a second amplifier connected to said first amplifier for receiving and said means said amplified DC output voltage signal and subtracting it from a value proportional to said desired temperature, and generating an output error signal representative of a difference between said desired temperature and said actual temperature;

g. a comparator also connected to said first amplifier for receiving said amplified DC output voltage signal and comparing it with an internal standard voltage, and generating an over temperature signal when said actual temperature exceeds the internal standard voltage;

h. a zero crossing detector coupled to an alternating current (AC) power signal for generating DC support voltages, and for detecting a zero crossing signal of the AC power signal;

i. a microprocessor connected to said second amplifier and said zero crossing detector for receiving said error signal and said zero crossing signal to provide a trigger signal, the microprocessor having an internal timer for providing a timing range;

j. an external timer connected to said microprocessor for assisting said internal timer to extend said timing range such that said internal timer and the external timer are used to set the proportionality of said PWM square wave;

k. said microprocessor being programmed for constantly calculating a proportional (P) term, an integral (I) term and a derivative (D) term based on an algorithm to determine operating characteristics of said trigger signal;

l. said algorithm including a loop equation utilizing a proportional constant $K_p$, an integral constant $K_i$ and a derivative constant $K_d$ which reflect physical dimensions of said water delivery system and said at least one heating element, said algorithm performing the functions of:

(i) waiting for an interrupt of said zero crossing signal;

(ii) calculating said proportional term which is said error signal times said proportional constant $K_p$;

(iii) calculating said integral term which is said integral constant $K_i$ times the integral of said error signal over said timing range;

(iv) calculating said derivative term which is said derivative constant $K_d$ times the current rate of change of said error signal;

(v) calculating a new PWM term by adding said P+I+D, such that the result is scaled by said constants;

(vi) retaining said new PWM term for setting said internal and external timers after a next interrupt of said zero crossing signal;

(vii) said new PWM term determines said operating characteristics of said trigger signal from said microprocessor; and m. an optocoupler connected to said microprocessor for receiving said trigger signal and providing full power of said AC power signal into said at least one heating element to heat up the water; and n. said optocoupler also connected to said comparator and having a triac and a light emitting diode (LED) for receiving said over temperature signal to provide a fail-safe shutdown of said system by preventing the optocoupler from turning the triac on such that with power removed from the triac, said at least one heating element cools within at least one half AC cycle and said outlet water temperature returns to a safe value;

o. whereby said microprocessor ensures that said characteristics of said trigger signal is quickly determined to quickly force the power levels to a sufficiently high value so that the incoming water can be heated rapidly.

Defined more broadly, the present invention is an apparatus for controlling a water delivery system, comprising: (a) a tankless water heater having an inlet, an outlet and a passage between the inlet and the outlet to permit a continuous flow of water from the inlet to the outlet; (b) at least one heating element mounted in said passage of said tankless water heater for heating water as it flows through said passage, and electrically connected with electronic control circuitry contained within said tankless water heater; (c) means for selecting a desired temperature of the water and generating a pulse width modulated (PWM) wave; (d) a temperature sensor for sensing an actual temperature of the water at said outlet of said tankless water heater and generating a direct current (DC) output voltage signal; (e) a first amplifier for receiving said DC output voltage signal and amplifying said DC output voltage signal; (f) a second amplifier for receiving said amplified DC output voltage signal and subtracting it from a value proportional to said desired temperature, and generating an output error signal; (g) a comparator for receiving said amplified DC output voltage signal and comparing it with a standard voltage, and generating a over temperature signal when said actual temperature exceeds the standard voltage; (h) a zero crossing detector coupled to an alternating current (AC) power signal for generating microprocessor timing voltages, and for detecting a zero crossing signal of the AC power signal; (i) a microprocessor connected to said second amplifier and said zero crossing detector for receiving said error signal and said zero crossing signal to provide a trigger signal, the microprocessor having an internal timer for providing a timing range; (j) an external timer connected to said microprocessor for assisting said internal timer to extend said timing range such that said internal timer and the external timer are used to set the proportionality of said PWM wave; (k) said microprocessor being programmed for constantly calculating a proportional (P) term, an integral (I) term and a derivative (D) term based on an algorithm to determine operating characteristics of said trigger signal; (I) said algorithm including a loop equation utilizing a proportional constant $K_p$, an integral constant $K_i$ and a derivative constant $K_d$; (m) an optocoupler connected to said microprocessor for receiving said trigger signal and providing full power of said AC power signal into said at least one heating element; and (n) said optocoupler also connected to said comparator and having a triac for receiving said over temperature signal to provide a fail-safe shutdown of said system by preventing the optocoupler from turning the triac on; (o) whereby said microprocessor ensures that said characteristics of said trigger signal is quickly determined to quickly force the power levels to a sufficiently high value so that the incoming water can be heated rapidly.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An apparatus for controlling a water delivery system to obtain precise set point temperatures and used in conjunction with a shower having means for detecting a person presence in a shower or lavatory, the apparatus comprising:

a. a housing having a water inlet, a water outlet and a passage between the water inlet and the water outlet to permit a continuous flow of water from the inlet to the outlet;

b. at least one heating element mounted in said passage of said housing for heating water as it flows through said passage, and electrically connected with electronic control circuitry contained within said housing;

c. a remote controllable temperature selection device for selecting a desired temperature of the water;

d. said remote temperature selection device further comprising:

(i) an up temperature button, a down temperature button and a cold button, all electrically connected with electronic selection circuitry contained within said temperature selection device;

(ii) said electronic selection circuitry further including a microcontroller having an digital-to-analog (D/A) converter for outputting a pulse width modulated (PWM) square wave proportional to said desired temperature and outputting a bit pattern representing said desired temperature;

(iii) an electrically erasable programmable read only memory (EEPROM) for storing said desired temperature, where each time said desired temperature is changed, it is written into the EEPROM;

(iv) a light emitting diode (LED or LCD) display receiving said bit pattern for displaying said desired temperature on a digital display; and e. a remote temperature sensor in fluid communication with the water for sensing a water temperature at said water outlet of said housing and operable to enable real time sensing of an actual temperature of the water and generating a linear direct current (DC) output voltage signal proportional to the actual temperature;

f. a filter/amplifier for receiving said DC output voltage signal from said remote temperature sensor to remove electrical noises and amplifying said DC output voltage signal;

g. a set point subtraction amplifier connected to said filter/amplifier and said temperature selection device for receiving said amplified DC output voltage signal and subtracting it from a value proportional to said desired temperature, and generating an output error signal representative of a difference between said desired temperature and said actual temperature;

h. an over temperature detection comparator also connected to said filter/amplifier for receiving said amplified DC output voltage signal and comparing it with an internal standard voltage, and generating an over temperature signal when said actual temperature exceeds the internal standard voltage;

h. a zero crossing detector coupled to an alternating current (AC) power signal for generating microprocessor timing voltages, and for detecting a zero crossing signal of the AC power signal;

j. a comparator coupled to said zero crossing detector for receiving said zero crossing signal to generate an interrupt on transitions of said zero crossing signal;

k. a microprocessor connected to said set point subtraction amplifier and said comparator for receiving said error signal and said zero crossing signal to provide a trigger signal, the microprocessor having an internal timer for providing a timing range;

l. an external timer connected to said microprocessor for assisting said internal timer to select 50 or 60 Hz said timing range such that said internal timer and the external timer are used to set the proportionality of said PWM square wave;

m. said microprocessor being programmed for constantly calculating a proportional (P) term, an integral (I) term and a derivative (D) term based on an algorithm to determine operating characteristics of said trigger signal;

n. said algorithm including a loop equation utilizing a proportional constant $K_p$, an integral constant $K_i$ and a derivative constant $K_d$ which reflect physical dimensions of said water delivery system and said at least one heating element, said algorithm performing the functions of:

(i) waiting for said interrupt of said zero crossing signal;

(ii) calculating said proportional term which is said error signal times said proportional constant $K_p$;

(iii) calculating said integral term which is said integral constant $K_i$ times the integral of said error signal over said timing range;

(iv) calculating said derivative term which is said derivative constant $K_d$ times the current rate of change of said error signal;

(v) calculating a new PWM term by adding said P+I+D, such that the result is scaled by said constants;

(vi) retaining said new PWM term for setting said internal and external timers after a next interrupt of said zero crossing signal;

(vii) said new PWM term determines said operating characteristics of said trigger signal from said microprocessor; and o. an optocoupler connected to said microprocessor for receiving said trigger signal and forcing full power of said AC power signal into said at least one heating element heat up the water; and p. said optocoupler also connected to said over temperature detection comparator and having a triac and a light emitting diode (LED) for receiving said over temperature signal to provide a fail-safe shutdown of said water delivery system by preventing the optocoupler from turning the triac "on" such that with power removed from the triac, said at least one heating element cools within at least one half AC cycle and said outlet water temperature returns to a safe value;

q. whereby said microprocessor ensures that said characteristics of said trigger signal is quickly determined to quickly force the power levels to a sufficiently high value so that the incoming water can be heated rapidly.

2. The apparatus as defined in claim 1 further comprising a low pass filter connected between said point subtraction amplifier and said electronic selection circuitry for receiving said PWM square wave, said electronic selection circuitry being in turn connected to a buffer amplifier which emits a direct current voltage that is directly proportional to the average value of said PWM square wave.

3. The apparatus as defined in claim 1 further comprising a voltage regulator for supplying a stable +5 volts to said electronic control circuitry and said electronic selection circuitry.

4. The apparatus as defined in claim 3 wherein said voltage regulator further comprises a filter for removing AC ripples from said stable +5 volts.

5. The apparatus as defined in claim 1 wherein said internal standard voltage is two fixed resistors.

6. The apparatus as defined in claim 1 wherein when said temperature selection device is powered up, said temperature selection is 0° C. or when said cold button is pressed, said desired temperature is 0° C.

7. The apparatus as defined in claim 1 wherein said remote temperature sensor is a two-terminal integrated circuit which provides a source current that is proportional to said actual temperature of said water.

8. The apparatus as defined in claim 1 wherein said microprocessor feds a 7.3728 Mhz signal to said external timer which in combination with said internal timer divides said signal by a fixed ratio dependent upon the frequency of said alternating current power signal.

9. An apparatus for controlling a water delivery system to obtain precise set point temperatures, the apparatus comprising:

a. a housing having an inlet, an outlet and a passage between the inlet and the outlet to permit a continuous flow of water from the inlet to the outlet;

b. at least one heating element mounted in said passage of said housing for heating water as it flows through said passage, and electrically connected with electronic control circuitry contained within said housing;

c. means for selecting a desired temperature of the water and generating a pulse width modulated (PWM) square wave proportional to the desired temperature;

d. a temperature sensor in fluid communication with the water for sensing an actual temperature of the water at said outlet of said housing and generating a direct current (DC) output voltage signal proportional to the actual temperature;

e. a first amplifier for receiving said DC output voltage signal from said temperature sensor to remove electrical noises and amplifying said DC output voltage signal;

f. a second amplifier connected to said first amplifier for receiving said amplified DC output voltage signal and subtracting it from a value proportional to said desired temperature, and generating an output error signal representative of a difference between said desired temperature and said actual temperature;

g. a comparator also connected to said first amplifier for receiving said amplified DC output voltage signal and comparing it with an internal standard voltage, and generating an over temperature signal when said actual temperature exceeds the internal standard voltage;

h. a zero crossing detector coupled to an alternating current (AC) power signal for generating DC support voltages, and for detecting a zero crossing signal of the AC power signal;

i. a microprocessor connected to said second amplifier and said zero crossing detector for receiving said error signal and said zero crossing signal to provide a trigger signal, the microprocessor having an internal timer for providing a timing range;

j. an external timer connected to said microprocessor for assisting said internal timer to extend said timing range to cover 50 or 60 Hz input power frequency such that said internal timer and the external timer are used to set the proportionality of said PWM square wave;

k. said microprocessor being programmed for constantly calculating a proportional (P) term, an integral (I) term and a derivative (D) term based on an algorithm to determine operating characteristics of said trigger signal;

l. said algorithm including a loop equation utilizing a proportional constant $K_p$, an integral constant $K_i$ and a derivative constant $K_d$ which reflect physical dimensions of said water delivery system and said at least one heating element, said algorithm performing the functions of:

(i) waiting for an interrupt of said zero crossing signal;

(ii) calculating said proportional term which is said error signal times said proportional constant $K_p$;

(iii) calculating said integral term which is said integral constant $K_i$ times the integral of said error signal over said timing range;

(iv) calculating said derivative term which is said derivative constant $K_d$ times the current rate of change of said error signal;

(v) calculating a new PWM term by adding said P+I+D, such that the result is scaled by said constants;

(vi) retaining said new PWM term for setting said internal and external timers after a next interrupt of said zero crossing signal;

(vii) said new PWM term determines said operating characteristics of said trigger signal from said microprocessor; and m. an optocoupler connected to said microprocessor for receiving said trigger signal and providing full power of said AC power signal into said at least one heating element to heat up the water; and n. said optocoupler also connected to said comparator and said optocoupler having a triac and a light emitting diode (LED) for receiving said over temperature signal to provide a fail-safe shutdown of said system by preventing the optocoupler from turning the triac on such that with power removed from the triac, said at least one heating element cools within less than one half AC cycle and said outlet water temperature returns to a safe value;

o. whereby said microprocessor ensures that said characteristics of said trigger signal is quickly determined to quickly force the power levels to a sufficiently high value so that the incoming water can be heated rapidly.

10. The apparatus as defined in claim 9 further comprising a low pass filter connected between said second amplifier and said electronic selection circuitry for receiving said means for selecting a desired temperature of the water.

11. The apparatus as defined in claim 9 further comprising a voltage regulator for supplying a stable +5 volts to said electronic control circuitry.

12. The apparatus as defined in claim 11 wherein said voltage regulator further comprises a filter for removing AC ripples from said stable +5 volts.

13. The apparatus as defined in claim 11 further comprising another comparator coupled to said zero crossing detector for receiving said zero crossing signal to generate an interrupt on transitions of said zero crossing signal.

14. The apparatus as defined in claim 9 wherein said internal standard voltage is formed by two fixed resistors.

15. The apparatus as defined in claim 9 wherein said temperature sensor is an a two-terminal integrated circuit which provides a source current that is proportional to said actual temperature of said water.

16. The apparatus as defined in claim 9 wherein said means for selecting said desired temperature level of the water includes a controllable temperature selection device, the temperature selection device further comprising:

a. an up temperature button, a down temperature button and a cold button, all electrically connected with electronic selection circuitry contained within said temperature selection device;

b. said electronic selection circuitry further including a microcontroller having an digital-to-analog (D/A) converter for outputting a pulse width modulated (PWM) square wave proportional to said desired temperature and outputting a bit pattern representing said desired temperature;

c. an electrically erasable programmable read only memory (EEPROM) for storing said desired temperature, where each time said desired temperature is changed, it is written into the EEPROM; and d. a light emitting diode (LED) display receiving said bit pattern for displaying said desired temperature on a digital display.

17. The apparatus as defined in claim 15 wherein when said temperature selection device is powered up, said temperature selection is 0° C. or when said cold button is pressed, said desired temperature is 0° C.

18. The apparatus as defined in claim 9 wherein said means for selecting said desired temperature of the water includes a trimmer potentiometer for fixed temperature operation.

19. The apparatus as defined in claim 9 wherein said means for selecting said desired temperature of the water includes a manual analog switch having a remote trimmer potentiometer for forcing said system to produce cold water.

20. The apparatus as defined in claim 9 wherein said microprocessorfeds a 7.3728 Mhz signal to said external timer which in combination with said internal timer divides said signal by a fixed ratio dependent upon the frequency of said alternating current power signal.

21. The apparatus as defined in claim 9 wherein said microprocessor being programmed to prevent trigger pulses from being provided to said optocoupler for more than one-half of the period of said one half AC cycle, said period beginning immediately after said zero crossing detector has detected a zero crossing of said AC power signal and said microprocessor has provided said trigger signal.

22. An apparatus for controlling a water delivery system, comprising:

a. a tankless water heater having an inlet, an outlet and a passage between the inlet and the outlet to permit a continuous flow of water from the inlet to the outlet;

b. at least one heating element mounted in said passage of said tankless water heater for heating water as it flows through said passage, and electrically connected with electronic control circuitry contained within said tankless water heater;

c. means for selecting a desired temperature of the water and generating a pulse width modulated (PWM) wave;

d. a temperature sensor for sensing an actual temperature of the water at said outlet of said tankless water heater and generating a direct current (DC) output voltage signal;

e. a first amplifier for receiving said DC output voltage signal and amplifying said DC output voltage signal;

f. a second amplifier for receiving said amplified DC output voltage signal and subtracting it from a value proportional to said desired temperature, and generating an output error signal;

g. a comparator for receiving said amplified DC output voltage signal and comparing it with a standard voltage, and generating a over temperature signal when said actual temperature exceeds the standard voltage;

h. a zero crossing detector coupled to an alternating current (AC) power signal for generating microprocessor timing support voltages, and for detecting a zero crossing signal of the AC power signal;

i. a microprocessor connected to said second amplifier and said zero crossing detector for receiving said error signal and said zero crossing signal to provide a trigger signal, the microprocessor having an internal timer for providing a timing range;

j. an external timer connected to said microprocessor for assisting said internal timer to extend said timing range such that said internal timer and the external timer are used to set the proportionality of said PWM wave;

k. said microprocessor being programmed for constantly calculating a proportional (P) term, an integral (I) term and a derivative (D) term based on an algorithm to determine operating characteristics of said trigger signal;

l. said algorithm including a loop equation utilizing a proportional constant $K_p$, an integral constant $K_i$ and a derivative constant $K_d$;

m. an optocoupler connected to said microprocessor for receiving said trigger signal and providing full power of said AC power signal into said at least one heating element; and n. said optocoupler also connected to said comparator and having a triac for receiving said over temperature signal to provide a fail-safe shutdown of said system by preventing the optocoupler from turning the triac on;

o. whereby said microprocessor ensures that said characteristics of said trigger signal is quickly determined to quickly force the power levels to a sufficiently high value so that the incoming water can be heated rapidly.

23. The apparatus as defined in claim 22 further comprising a low pass filter connected between said second amplifier and said electronic selection circuitry for receiving said means for selecting a desired temperature of the water.

24. The apparatus as defined in claim 22 further comprising a voltage regulator for supplying a stable +5 volts to said electronic control circuitry.

25. The apparatus as defined in claim 24 wherein said voltage regulator further comprises a filter for removing AC ripples from said stable +5 volts.

26. The apparatus as defined in claim 22 wherein said means for selecting said desired temperature of the water includes a digital remote interface temperature selection device.

27. The apparatus as defined in claim 22 wherein said means for selecting said desired temperature of the water includes a trimmer potentiometer for fixed temperature operation.

28. The apparatus as defined in claim 22 wherein said means for selecting said desired temperature of the water includes a manual switch having a potentiometer.

29. The apparatus as defined in claim 22 further comprising another comparator coupled to said zero crossing detector for receiving said zero crossing signal to generate an interrupt on transitions of said zero crossing signal.

30. The apparatus as defined in claim 22 wherein said algorithm performing the functions of:

a. waiting for an interrupt of said zero crossing signal;

b. calculating said proportional term which is said error signal times said proportional constant $K_p$;

c. calculating said integral term which is said integral constant $K_i$ times the integral of said error signal over said timing range;

d. calculating said derivative term which is said derivative constant $K_d$ times the current rate of change of said error signal;

e. calculating a new PWM term by adding said P+I+D, such that the result is scaled by said constants;

f. retaining said new PWM term for setting said internal and external timers after a next interrupt of said zero crossing signal; and g. said new PWM term determines said operating characteristics of said trigger signal from said microprocessor.

31. The apparatus as defined in claim 22 wherein said microprocessorfeds a 7.3728 Mhz signal to said external timer which in combination with said internal timer divides said signal by a fixed ratio dependent upon the frequency of said alternating current power signal.

32. The apparatus as defined in claim 22 wherein said microprocessor being programmed to prevent trigger pulses from being provided to said optocoupler for a period of time immediately after said zero crossing detector has detected a zero crossing of said AC power signal and said microprocessor has provided said trigger signal.

33. An apparatus for controlling a water delivery system to obtain precise set point temperatures and used in conjunction with a shower having means for detecting a person presence in a shower or lavatory, the apparatus comprising:

a. a housing having a water inlet, a water outlet and a passage between the water inlet and the water outlet to permit a continuous flow of water from the inlet to the outlet;

b. at least one heating element mounted in said passage of said housing for heating water as it flows through said passage, and electrically connected with electronic control circuitry contained within said housing;

c. a remote controllable temperature selection device for selecting a desired temperature of the water;

d. said remote temperature selection device further comprising:

(i) an up temperature button, a down temperature button and a cold button, all electrically connected with electronic selection circuitry contained within said temperature selection device;

(ii) said electronic selection circuitry further including a microcontroller having an digital-to-analog (D/A) converter for outputting a pulse width modulated (PWM) square wave proportional to said desired temperature and outputting a bit pattern representing said desired temperature;

(iii) an electrically erasable programmable read only memory (EEPROM) for storing said desired temperature, where each time said desired temperature is changed, it is written into the EEPROM;

(iv) a light emitting diode (LED or LCD) display receiving said bit pattern for displaying said desired temperature on a digital display; and e. a temperature sensor in fluid communication with the water for sensing a water temperature at said water outlet of said housing and operable to enable real time sensing of an actual temperature of the water and generating a linear direct current (DC) output voltage signal proportional to the actual temperature;

f. a filter/amplifier for receiving said DC output voltage signal from said remote temperature sensor to remove electrical noises and amplifying said DC output voltage signal;

g. a set point subtraction amplifier connected to said filter/amplifier and said temperature selection device for receiving said amplified DC output voltage signal and subtracting it from a value proportional to said desired temperature, and generating an output error signal representative of a difference between said desired temperature and said actual temperature;

h. an over temperature detection comparator also connected to said filter/amplifier for receiving said amplified DC output voltage signal and comparing it with an internal standard voltage, and generating an over temperature signal when said actual temperature exceeds the internal standard voltage;

i. a zero crossing detector coupled to an alternating current (AC) power signal for generating microprocessor timing voltages, and for detecting a zero crossing signal of the AC power signal;

j. a comparator coupled to said zero crossing detector for receiving said zero crossing signal to generate an interrupt on transitions of said zero crossing signal;

k. a microprocessor connected to said set point subtraction amplifier and said comparator for receiving said error signal and said zero crossing signal to provide a trigger signal, the microprocessor having an internal timer for providing a timing range;

l. said microprocessor being programmed to prevent trigger signals from being provided to said optocoupler for a period of time immediately after said zero crossing detector has detected a zero crossing of said AC power signal and said microprocessor has provided said trigger signal;

m. an external timer connected to said microprocessor for assisting said internal timer to select 50 or 60 Hz said timing range such that said internal timer and the external timer are used to set the proportionality of said PWM square wave;

n. said microprocessor being programmed for constantly calculating a proportional (P) term, an integral (I) term and a derivative (D) term based on an algorithm to determine operating characteristics of said trigger signal;

o. said algorithm including a loop equation utilizing a proportional constant $K_p$, an integral constant $K_i$ and a derivative constant $K_d$ which reflect physical dimensions of said water delivery system and said at least one heating element, said algorithm performing the functions of:

(i) waiting for said interrupt of said zero crossing signal;

(ii) calculating said proportional term which is said error signal times said proportional constant $K_p$;

(iii) calculating said integral term which is said integral constant $K_i$ times the integral of said error signal over said timing range;

(iv) calculating said derivative term which is said derivative constant $K_d$ times the current rate of change of said error signal;

(v) calculating a new PWM term by adding said P+I+D, such that the result is scaled by said constants;

(vi) retaining said new PWM term for setting said internal and external timers after a next interrupt of said zero crossing signal;

(vii) said new PWM term determines said operating characteristics of said trigger signal from said microprocessor; and p. an optocoupler connected to said microprocessor for receiving said trigger signal and forcing full power of said AC power signal into said at least one heating element heat up the water; and q. said optocoupler also connected to said over temperature detection comparator and having a triac and a light emitting diode (LED) for receiving said over temperature signal to provide a fail-safe shutdown of said water delivery system by preventing the optocoupler from turning the triac "on" such that with power removed from the triac, said at least one heating element cools within at least one half AC cycle and said outlet water temperature returns to a safe value;

r. whereby said microprocessor ensures that said characteristics of said trigger signal is quickly determined to quickly force the power levels to a sufficiently high value so that the incoming water can be heated rapidly.

34. The apparatus as defined in claim 33 wherein said microprocessor being programmed to prevent trigger signals from being provided to said optocoupler for more than one-half of the period of said one half AC cycle, said period beginning immediately after said zero crossing detector has detected a zero crossing of said AC power signal and said microprocessor has provided said trigger signal.

* * * * *